United States Patent [19]

Gravemann

[11] Patent Number: 5,074,921

[45] Date of Patent: Dec. 24, 1991

[54] COPPER ALLOY AND METHOD

[75] Inventor: Horst Gravemann, Osnabrueck, Fed. Rep. of Germany

[73] Assignee: Kabel und Metallwerke, Osnabrueck, Fed. Rep. of Germany

[21] Appl. No.: 596,535

[22] Filed: Oct. 12, 1990

Related U.S. Application Data

[62] Division of Ser. No. 74,229, Jul. 16, 1987, abandoned.

[51] Int. Cl.[5] ..... C22F 1/08

[52] U.S. Cl. ..... 148/2; 148/11.5 C

[58] Field of Search ..... 148/2, 11.5 C; 420/477

[56] References Cited

U.S. PATENT DOCUMENTS 4,224,066 9/1980 Watson et al. ..... 148/11.5 C 4,728,372 3/1988 Caron et al. ..... 148/2

*Primary Examiner*—R. Dean

*Assistant Examiner*—George Wyszomierski

*Attorney, Agent, or Firm*—R. H. Siegemund

[57] ABSTRACT

Method of making a copper alloy to be used as a mold for continuous casting and comprising from 0.05% to 0.4% zinc; from 0.02% to 0.3% magnesium; from 0.02% to 0.2% phosphorus; all percentages by weight; the remainder being copper, and inevitable impurities; the alloy is cast and hot worked possibly followed by quenching and cold working with at least 10% deformation; the alloy is then annealed from 1 to 6 hours at a temperature from 300° to 550° centigrade; and finally cold worked with at least 10% deformation.

6 Claims, No Drawings

COPPER ALLOY AND METHOD

This is a divisional of co-pending application Ser. No. 74,229 filed on Jul. 16, 1987, abandoned.

BACKGROUND OF THE INVENTION

The present invention relates to a copper alloy as well as to the making of a copper alloy in preparation of the making, and to be used within the process of making, a mold for continuous casting, such as a mold for continuous casting of high melting metals, such as steel.

In the past molds to be used for this purpose were made of copper of the type SF—Cu, which, owing to its particularly high thermal conductivity is capable of extracting rapidly a large amount of heat from the molten metal being cast. The walls of the mold are (or can be made) sufficiently thick so that they can take up the expected mechanical load and wear. In order to increase the hot strength of such a mold, it has been proposed to use an alloy that includes at least 85% copper and at least one alloying element which causes precipitation hardening. Here then, one may use up to 3% chromium, silicon, silver, and beryllium. However, a mold made of this particular alloy was not completely satisfactory, because, unfortunately the particular components silicon and beryllium reduced its thermal conductivity of the resulting product rather drastically (see AT-Patent 234,930).

DESCRIPTION OF THE INVENTION

It is an object of the present invention to provide a new and improved copper alloy with a very high thermal conductivity and a high mechanical strength, particularly in temperatures above 300° centigrade, and having a high, hot plasticity. The material is to be used, or useable, primarily for the making of molds for continuous casting.

In accordance with the preferred embodiment of the present invention, a copper alloy is suggested, wherein the alloying components are, from 0.05% to 0.4% zinc; from 0.02% to 0.3% magnesium; from 0.02% to 0.2% phosphorus; all percentages by weight; the remainder being copper, and inevitable impurities resulting from the manufacturing.

Generally, it is known that the addition of zinc or magnesium reduces the conductivity of copper. However, the reduction is not very large, while phosphorus when added to copper, produces a drastic reduction in thermal conductivity. The strength, however, is increased by the addition of zinc-magnesium or phosphorus. It is quite surprising that by using all three of these elements within the stated ranges the thermal conductivity of copper as compared with the commercially useable SF-copper is hardly reduced at all. Owing to the mixed crystal hardening, augmented by supplemental hardening through phosphide formation, the strength is considerably higher as compared with the SF-copper, bearing in mind that phosphide is amenable to precipitation. Particularly the hot strength is considerably better than the hot strength of SF-copper. It was found that an alloy being comprised from 0.1 to 0.25% zinc, from 0.05 to 0.15% magnesium, and from 0.05 to 0.1% phosphorus, all percentages by weight, the remainder copper and inevitable impurities, is of particular advantage.

The addition of silicon up to 0.2%, preferably about only 0.1% by weight, has a positive effect on the hardness and, therefore, improves the wear proofing. Adding up to 0.15% zirconium increases the hot plasticity. Moreover, these additions in combination with a particularly controlled heat treatment, improves the softening aspects of the material. Both additions, silicon and zirconium, in the stated concentrations, will not reduce to any noticeable extent the thermal conductivity.

As far as the making of such an alloy of the type described above, is concerned, it is an inventive contribution to proceed as follows. In accordance with the preferred embodiment of making the inventive alloy, it is proposed to cast the alloy in the stated composition and, subsequently to hot work the casting following which the alloy is annealed from 1 to 5 hours at 300° to 550° centrigrade, and finally cold worked at a degree of deformation of at least 10%. An additional 10% minimum cold deformation in between the hot working, on one hand, and the precipitation annealing at 300° to 550° centigrade on the other hand has a very positive effect on the homogenization and on the combination of features and desirable characteristics. However, it is essential that there be a minimal 10% cold working to succeed any respective last annealing.

It is of a particular advantage to hot work the alloy above the temperature of maximum solvability of the alloying components, and then to quench by about 750° centigrade. This feature establishes an additional hardening; a solution annealing (homogenization) may be carried out separately from the hot working. However, quenching from a homogenization annealing and/or hot working at a temperature above 750 degrees C. may be only down to the 300 to 550 degrees C. of subsequent annealing. Quenching to room temperature may be advisable if the final annealing is deferred for some reason or if the additional cold working step is interposed.

The invention is explained more fully with reference to a specific example. It is assumed that an alloy is made, having a composition of 0.19% zinc, 0.09% magnesium, 0.07% phosphorus, the remainder copper, and inevitable impurities, all percentages by weight. Following casting, this material was hot worked through extrusion, and the extruded product was then drawn (cold) following cooling for the degree a deformation of 20%. This alloy was then annealed for five hours, and at about 500° centigrade. Samples were produced, which were respectively cold worked at 10%, 20% and 40%. Tables A, B, and C show the properties of these samples, and compare the same to SF-copper, as well as to a copper-chromium-zirconium alloy.

Comparing, from an overall point of view, the new materials with the properties of SF-copper, as it was usually used for making molds for continuous casting, illustrates very clearly that for comparable degrees of deformation the strength values of the metal alloy are higher by about 10–50%. The thermal conductivity is likewise considerably higher. Very important, however, is that the softening at higher temperature is like much more favorable with the novel alloy. This alloy, for example, softens for comparable conductivity only at a temperature of above 500° centigrade. In addition, there is a considerably lower creepage extension at higher temperatures, which guarantees a better tendency to maintain dimensions and contour. Particularly, distortion is avoided.

From an overall point of view, it can be expected that the novel copper alloy in accordance with the invention, is a very good material for making molds for continuous casting. If one compares such an alloy with the copper chromium allows, the inventive alloy has better properties. The inventive alloy can be made much easier and simpler, and the alloying elements as used are more economical. Thus, from an overall point of view, molds to be used for continuous casting and made from the new material, other conditions being equal, are considerably more economical. Somewhat better are the technological properties of the alloy, if the hot working is carried out at a solution annealing temperature, whereupon the material is quenched, and then the various steps outlined above will follow. Through precipitation of intermediate phases from the copper matrix, one can obtain still more favorable strength and values as well as values for the thermal conductivity.

TABLE A

| MATERIAL: | SF—Cu | CuZn 0.2 | Mg 0.09 | P 0.075 | CuCrZr |
|---|---|---|---|---|---|
| % DEFORMATION: | 25 | 10 | 20 | 40 | cold def. & hardened. |
| $R_m$: (=tensile strength in N/mm$^2$) (3-sample average) | 277 | 365 | 385 | 420 | 448 |
| $R_p$ 0.2: (=0.2% stretch limit in N/mm$^2$; 3-sample average) | 275 | 356 | 378 | 400 | 329 |
| $A_5$: (=% expansion at rupture; 3-sample average) | 17 ($A_{10}$) | 13.5 | 12.5 | 12.0 | 27 ($A_{10}$) |
| Z: (=% cross sectional constriction at fracture; 3-sample average) | 82 | 74 | 74 | 70 | 65 |
| HB 2.5/6.25: (=2.5/6.25 Brinell hardness; 3-sample average) | 91 | 104 | 112 | 115 | 140 |
| ELECTRICAL CONDUCTIVITY: (Siemens · meter/mm$^2$) | 47 | 49.5 | 49.5 | 49.5 | 49.5 |
| SEMI-HARD SOFTENING TEMPERATURE: (0.5 hours annealing in degrees C.) | 400 | 575 | 565 | 550 | 500 |
| SEMI-HARD ANNEALING TIME: (at 350 degrees C. in hours) | 2-3 | 64 | 64 | 64 | — |

TABLE B

| MATERIAL: | SF—Cu | CuZn 0.2 | Mg 0.1 | P 0.08 | CuCrZr |
|---|---|---|---|---|---|
| % DEFORMATION: | 25 | 10 | 20 | 40 | 10 |
| CREEP EXTENSIONS AT A LOAD OF 150 N/mm$^2$, AT 200 degrees C., FOR A TOTAL OF 6 HOURS IN %: | 0.035 | 0.023 | 0.014 | 0.027 | 0.006 |
| CREEP EXTENSIONS AT A LOAD OF 150 N/mm$^2$, AT 200 degrees C., FOR A TOTAL OF 24 HOURS IN %: | 0.05 | 0.035 | 0.047 | 0.059 | 0.008 |
| CREEP EXTENSIONS AT A LOAD OF 150 N/mm$^2$, AT 200 degrees C., FOR A TOTAL OF 72 HOURS IN %: | 0.07 | 0.041 | 0.055 | 0.064 | 0.012 |
| CREEP EXTENSIONS AT A LOAD OF 150 N/mm$^2$, AT 200 degrees C., FOR A TOTAL OF 216 HOURS IN %: | 0.10 | 0.049 | 0.078 | 0.086 | 0.014 |
| CREEP EXTENSIONS AT A LOAD OF 150 N/mm$^2$, AT 200 degrees C., FOR A TOTAL OF 500 HOURS IN %: | 0.14 | 0.086 | 0.080 | 0.100 | 0.014 |
| CREEP EXTENSIONS AT A LOAD OF 150 N/mm$^2$, AT 200 degrees C., FOR A TOTAL OF 1000 HOURS IN %: | 0.20 | 0.096 | 0.082 | 0.107 | 0.014 |
| CREEP EXTENSIONS AT A LOAD OF 150 N/mm$^2$, AT 200 degrees C., FOR A TOTAL OF 2000 HOURS IN %: | 0.320 | 0.110 | 0.100 | 0.120 | 0.014 |

TABLE C

| MATERIAL: | SF—Cu | CuZn 0.2 | Mg 0.1 | P 0.08 | CuCrZr |
|---|---|---|---|---|---|
| % DEFORMATION: | 25 | 10 | 20 | 40 | 10 |
| CREEP EXTENSIONS AT A LOAD OF 150 N/mm$^2$, AT 250 degrees C., FOR A TOTAL OF 6 HOURS IN %: | 0.11 | 0.053 | 0.036 | 0.030 | 0.012 |
| CREEP EXTENSIONS AT A LOAD OF 150 N/mm$^2$, AT 250 degrees C., FOR A TOTAL OF 24 HOURS IN %: | 0.31 | 0.055 | 0.053 | 0.047 | 0.014 |
| CREEP EXTENSIONS AT A LOAD OF 150 N/mm$^2$, AT 250 degrees C., FOR A TOTAL OF 72 HOURS IN %: | 0.58 | 0.073 | 0.093 | 0.079 | 0.014 |
| CREEP EXTENSIONS AT A LOAD OF 150 N/mm$^2$, AT 250 degrees C., | 1.27 | 0.120 | 0.140 | 0.130 | 0.014 |

TABLE C-continued

| | | | | | |
|---|---|---|---|---|---|
| FOR A TOTAL OF 216 HOURS IN %: | | | | | |
| CREEP EXTENSIONS AT A LOAD OF 150 N/mm$^2$, AT 250 degrees C., FOR A TOTAL OF 500 HOURS IN %: | 4.57 | 0.140 | 0.180 | 0.160 | 0.014 |
| CREEP EXTENSIONS AT A LOAD OF 150 N/mm$^2$, AT 250 degrees C., FOR A TOTAL OF 1000 HOURS IN %: | * | 0.210 | 0.310 | 0.260 | 0.014 |
| CREEP EXTENSIONS AT A LOAD OF 150 N/mm$^2$, AT 250 degrees C., FOR A TOTAL OF 2000 HOURS IN %: | * | * | * | 0.600 | 0.014 |

* = premature fracture

The invention is not limited to the embodiments described above, but all changes and modifications thereof not constituting departures from the spirit and scope of the invention, are intended to be included.

I claim:

1. Method of making a copper alloy for a mold for continuous casting, comprising, subjecting a copper alloy comprising from 0.1% to 0.25% zinc; from 0.05% to 0.15% magnesium; from 0.05% to 0.1% phosphorus; all percentages by weight; the remainder being copper, and inevitable impurities, to the steps of:

casting and hot working the alloy;

annealing the alloy from 1 to 6 hours at a temperature from 300° to 550° centigrade; and cold working the annealed alloy with at least 10% but not more than 40% deformation, there being no further annealing after the cold working.

2. Method as in claim 1, including additionally cold working the alloy with at least a 10% deformation and following hot working and prior to annealing.

3. Method as in claim 1, wherein said hot working is carried out at a temperature above the maximum solution temperature of said alloy, and including the step of quenching the alloy down from at least 750° centigrade.

4. Method as in claim 3, wherein the quenching is carried out down to annealing temperature.

5. Method as in claim 3 wherein the quenching is carried out down to room temperature.

6. Method as in claim 1 including a homogenizing annealing above 750 degrees C. following the hot working and prior to annealing.

* * * * *